US007519321B2

(12) United States Patent
Matsutomo

(10) Patent No.: US 7,519,321 B2
(45) Date of Patent: Apr. 14, 2009

(54) IMAGE FORMING APPARATUS WITH PAIR OF SELECTABLE IDLER ROLLERS FOR DISCHARGING COPIES BASED ON A POST-PROCESS

(75) Inventor: Yasushi Matsutomo, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 459 days.

(21) Appl. No.: 11/328,536

(22) Filed: Jan. 10, 2006

(65) Prior Publication Data

US 2006/0159501 A1 Jul. 20, 2006

(30) Foreign Application Priority Data

Jan. 19, 2005 (JP) ..... 2005-011728

(51) Int. Cl.
*G03G 15/00* (2006.01)

(52) U.S. Cl. ..... 399/410; 399/405; 399/407

(58) Field of Classification Search ..... 399/410, 399/405, 407
See application file for complete search history.

(56) References Cited

U.S. PATENT DOCUMENTS 6,120,020 A * 9/2000 Asao ..... 271/189
6,305,681 B1 * 10/2001 Watanabe et al. ..... 270/58.08
6,666,444 B1 * 12/2003 Paoli ..... 270/58.11
6,671,491 B1 * 12/2003 Yamanaka et al. ..... 399/407
2003/0063175 A1 * 4/2003 Nishikawa ..... 347/104

FOREIGN PATENT DOCUMENTS

JP 2004-145200 5/2004

* cited by examiner

*Primary Examiner*—Daniel J Colilla
*Assistant Examiner*—Jung H Nam
(74) *Attorney, Agent, or Firm*—Renner, Otto, Boisselle & Sklar, LLP

(57) ABSTRACT

In an image forming apparatus in which a scanner portion is disposed in an upper portion of the apparatus, a paper cassette is disposed in a lower portion of the apparatus, and a print portion is disposed between the scanner portion and the paper cassette, in one embodiment, a paper post-processing portion that performs paper post-processing for paper transported from the apparatus main body after printing is disposed in a space of the apparatus main body formed by the scanner portion, the print portion, and the paper cassette. Provided in a discharge roller portion that discharges paper from the paper post-processing portion to a discharge tray are a drive roller, and a first idler roller and second idler roller that form a pair with the drive roller and can be selectively used when discharging paper to the discharge tray.

12 Claims, 5 Drawing Sheets

IMAGE FORMING APPARATUS WITH PAIR OF SELECTABLE IDLER ROLLERS FOR DISCHARGING COPIES BASED ON A POST-PROCESS

CROSS REFERENCE TO RELATED APPLICATIONS

This application claims priority under 35 U.S.C. § 119(a) on Patent Application No. 2005-11728 filed in Japan on Jan. 19, 2005, the entire contents of which are hereby incorporated by reference.

BACKGROUND OF THE INVENTION

1. Field of the Invention

The present invention relates to an image forming apparatus provided with a so-called inner finisher.

2. Related Art

In recent years, development of apparatuses using front access systems and built-up systems as a part of compact design of image forming apparatuses has been advancing.

In image forming apparatuses using a front access system, operation of an operating portion (also including a display portion), opening and closing of an opening/closing door, replenishment of paper in a feed portion, and extraction of paper from a discharge portion can all be performed from the front side of the apparatus. Also, such apparatuses are configured so that with the exception of replenishing paper in the feed portion, it is not necessary for a user to change their posture in front of the apparatus.

In image forming apparatuses using a built-up system, a configuration is adopted in which a feed portion is disposed in the lowest portion of the apparatus main body, a print portion is disposed above the feed portion, a discharge portion is disposed on the top face or a side face of the print portion, and an original reading device is disposed above those portions; that is, in the uppermost portion of the apparatus. Such apparatuses are configured so that it is possible to avoid paper jams by forming a paper transport path, that transports paper housed in the feed portion to the discharge portion via the print portion, in an approximately perpendicular upward direction. Further, by building up a plurality of feed portions, it is possible to print to paper with a plurality of sizes.

Also, in recent years, in order to achieve multiple functions in the image forming apparatus, development of paper post-processing apparatuses, in which paper post-processing such as staple processing, punch processing, and binding processing are performed, has been advancing. Paper post-processing apparatuses are also being installed in image forming apparatuses that employ a front access system and a built-up system as described above However, for example, as disclosed in JP 2004-145200A, in an image forming apparatus using a built-up system, designing a paper post-processing apparatus on the side face of the image forming apparatus main body leads to enlargement of the apparatus as a whole, and is contrary to demands for a more compact apparatus. Thus, development of so-called inner-finisher paper post-processing apparatuses has been advancing. Specifically, a paper post-processing apparatus is not disposed outside of the image forming apparatus, and by disposing the paper post-processing apparatus together with the discharge portion in a space formed within the apparatus, an attempt is made to achieve a more compact apparatus.

However, image forming apparatuses provided with a conventional inner finisher have the following sorts of problems.

When the inner finisher is provided with a staple function, a staple processing stage used when performing staple processing is provided on the upstream side of the discharge portion. When staple processing is performed, paper for which printing is finished is discharged in order to the staple processing stage. Then, after paper adjustment, staple processing is performed, and after staple processing, a paper batch is collectively discharged to a discharging means from a pair of discharge rollers. On the other hand, when staple processing is not performed, paper for which printing is finished is discharged page by page to the discharging means from the discharge rollers via the staple processing stage.

However, as described above, when the inner finisher is provided using a space formed within the image forming apparatus, and a staple function is also provided, because it is necessary to provide both the above-mentioned staple processing stage and the discharging means in that space, the length of the staple processing stage in the paper discharge direction (the paper transport direction) may become shorter than the length in the paper transport direction of the paper for which staple processing is attempted. In such a case, there is the problem that with the pair of discharge rollers that discharge the paper to the discharging means from the staple processing stage in a contact state, staple processing cannot be performed for paper that is longer than the length of the staple processing stage in the paper discharge direction.

Also, paper is discharged to the discharging means by the pair of discharge rollers, but when one of the pair of rollers is made a drive roller and the other is made an idler roller, it is possible to discharge paper page by page from the discharge rollers to the discharging means when staple processing is not performed in the inner finisher. However, when staple processing is performed in the inner finisher, the following sort of problems occur when discharging a paper batch from the discharge rollers after staple processing. With respect to paper that is in contact with the drive roller, it is possible to confer transport force in the paper transport direction with rotation of the drive roller, but on the other hand, with respect to paper that is not in contact with the drive roller, it is not possible to confer sufficient transport force in the paper transport direction. As a result, there is the problem that only paper that is in contact with the drive roller is transported, and the paper is torn at the staple portion that binds the paper batch together. This sort of problem is more likely to occur as the number of pages of paper bound by the staple processing increases.

Further, when the inner finisher is also provided with a shifter function, it is convenient from the point of view of making the apparatus more compact, decreasing the number of members, and decreasing cost if the above-mentioned discharge rollers that discharge paper from the staple processing stage to the discharging means are also used as shifter rollers that execute shifter processing.

SUMMARY OF THE INVENTION

It is an object of the present invention to provide an image forming apparatus in which, while satisfying demands for a more compact apparatus, it is possible to perform staple processing even for paper that is longer in the paper discharge direction than the staple processing stage. It is another object of the present invention to provide an image forming apparatus in which, when discharging a paper batch from the discharge rollers after staple processing, it is possible to prevent the paper from tearing at the staple portion where the paper batch is bound.

The image forming apparatus of the present invention, in which an original reading portion is disposed in an upper portion of an apparatus main body, a feed portion is disposed in a lower portion of the apparatus main body, and a print portion is disposed between the original reading portion and the feed portion, includes a paper post-processing portion that performs paper post-processing for paper transported from the apparatus main body after printing by the print portion is finished, disposed in a space of the apparatus main body formed by the original reading portion, the print portion, and the feed portion; a drive roller provided in a discharge roller portion that discharges paper from the paper post-processing portion to a discharge portion; and at least two idler rollers provided in the discharge roller portion that form a pair with the drive roller and can be selectively used when discharging paper to the discharge portion. In this manner, the image forming apparatus of the present invention is configured as an image forming apparatus provided with a so-called inner finisher. Thus, it is possible to achieve conservation of space by suppressing the occupied surface area of an image forming apparatus provided with the paper post-processing portion. Accordingly, it is not necessary to provide the paper post-processing portion outside of the apparatus main body even when the image forming apparatus uses a front access system and a built-up system, and demands for a more compact size can be satisfied.

With an image forming apparatus having this sort of configuration, because at least two idler rollers are provided that form a pair with the drive roller and can be selectively used when discharging paper to the discharge portion, it is possible to reliably discharge paper to the discharge portion by selectively using a plurality of the idler rollers according to the situation.

Also, in the image forming apparatus of the present invention, a configuration may be adopted in which the idler roller to be used for paper discharge is selected according to the processing contents of the paper post-processing portion.

With an image forming apparatus having this sort of configuration, by selectively using a plurality of the idler rollers according to the processing contents of the paper post-processing, it is possible to reliably discharge paper to the discharge portion.

Also, in the image forming apparatus of the present invention, a configuration may be adopted in which the processing contents of the paper post-processing portion are the presence or absence of staple processing in the paper post-processing portion.

With an image forming apparatus having this sort of configuration, by selectively using a plurality of the idler rollers according to the presence or absence of staple processing in the paper post-processing portion, it is possible to reliably perform paper discharge to the discharge portion with respect to either one page of paper for which staple processing is not performed or a paper batch of a plurality of pages of paper for which staple processing has been performed.

In the following description, when it is necessary to distinguish among a plurality of the idler rollers, an idler roller used when staple processing is performed in the paper post-processing portion will be referred to as a "first idler roller", and an idler roller used when staple processing is not performed in the paper post-processing portion will be referred to as a "second idler roller".

Also, in the image forming apparatus of the present invention, a configuration may be adopted in which at least one of the idler rollers is a first idler roller, and the first idler roller is provided such that it can be put in contact with or separated from the drive roller with which it forms a pair. Here, the drive roller and the first idler roller with which it forms a pair are in a separated state during staple processing in the paper post-processing portion, and are in a contact state after staple processing.

With an image forming apparatus having this sort of configuration, by selectively using a plurality of the idler rollers according to the presence or absence of staple processing in the paper post-processing portion, it is possible to reliably perform paper discharge to the discharge portion with respect to a paper batch of a plurality of pages of paper for which staple processing has been performed. Here, the drive roller and the first idler roller with which it forms a pair are put in a separated state during staple processing, and the leading edge of the paper for which staple processing is performed is made to protrude from between the rollers. When doing so, it is possible to perform staple processing even for paper that is longer in the paper transport direction than the staple processing stage. Thus, the length of the staple processing stage for staple processing in the paper transport direction can be shortened, and it is possible to achieve a more compact paper post-processing portion, and by extension, a more compact image forming apparatus. On the other hand, after staple processing, the rollers are put in a contact state and the paper batch is discharged to the discharge portion. Thus, it is not necessary to separately provide a mechanism that discharges the paper batch to the discharge portion after staple processing, such as a mechanism that pushes out the paper batch, for example.

Also, in the image forming apparatus of the present invention, a configuration may be adopted in which the first idler roller that forms a pair with the drive roller is provided such that it can actively rotate with the drive roller when discharging a paper batch after staple processing.

With an image forming apparatus having this sort of configuration, when discharging a paper batch to the discharge portion after staple processing, by actively rotationally driving not only the drive roller but also the first idler roller with which the drive roller forms a pair, it is possible to confer sufficient transport force in the paper transport direction (the paper discharge direction) even with respect to paper that is not in contact with the drive roller. That is, with respect to paper that is in contact with the first idler roller that forms a pair with the drive roller, transport force can be conferred in the paper discharge direction by active rotation of the first idler roller, and with respect to midway paper that is not in contact with either roller, it is possible to confer transport force in the paper discharge direction via the staple portion where the paper batch is bound. Thus, when discharging a paper batch to the discharge portion, it is possible to prevent tears in the paper at the staple portion.

Here, in order to make it possible for the first idler roller that forms a pair with the drive roller to actively rotate along with the drive roller, an idler roller side drive portion (such as a gear, for example) that links with a drive roller side drive portion (such as a gear, for example) provided in the drive roller may be provided in the first idler roller that forms a pair with the drive roller.

Also, in the image forming apparatus of the present invention, a configuration may be adopted in which a second idler roller that is an idler roller other than the first idler roller and that is used when staple processing is not performed in the paper post-processing portion is in contact with the drive roller with which it forms a pair.

With an image forming apparatus having this sort of configuration, by selectively using a plurality of the idler rollers according to the presence or absence of staple processing in the paper post-processing portion, it is possible to reliably perform paper discharge to the discharge portion for one page of paper for which staple processing has not been performed.

Here, the second idler roller idly rotates along with rotation of the drive roller when discharging paper to the discharge portion. When staple processing is not performed, because paper is discharged to the discharge portion page by page, unlike when staple processing is performed, sufficient transport force in the paper transport direction can be insured even when the second idler roller does not actively rotationally drive, and it is possible to reliably discharge paper to the discharge portion.

Also, in the image forming apparatus of the present invention, a configuration may be adopted in which a contacting nip region when the first idler roller and the drive roller with which it makes a pair are in contact is larger than the contacting nip region when the second idler roller and the drive roller with which it makes a pair are in contact.

With an image forming apparatus having this sort of configuration, by selectively using a plurality of the idler rollers according to the presence or absence of staple processing in the paper post-processing portion, it is possible to reliably perform paper discharge to the discharge portion with respect to either one page of paper for which staple processing is not performed or a paper batch of a plurality of pages of paper for which staple processing has been performed. When staple processing is not performed, because paper is discharged to the discharge portion page by page, even if the contacting nip region is small, it is possible to insure sufficient transport force in the paper transport direction, and paper can be reliably discharged to the discharge portion. On the other hand, when staple processing is performed, because a paper batch must be discharged to the discharge portion, the contacting nip region is enlarged to insure a large transport force in the paper transport direction, so that it is possible to reliably discharge a paper batch to the discharge portion.

Also, in the image forming apparatus of the present invention, a configuration may be adopted in which the hardness of the outer circumferential portion of the first idler roller is less than the hardness of the outer circumferential portion of the second idler roller.

With an image forming apparatus having this sort of configuration, by selectively using a plurality of the idler rollers according to the presence or absence of staple processing in the paper post-processing portion, it is possible to reliably perform paper discharge to the discharge portion with respect to either one page of paper for which staple processing is not performed or a paper batch of a plurality of pages of paper for which staple processing has been performed. When staple processing is not performed, because paper is discharged to the discharge portion page by page, even if the hardness of the outer circumferential portion of the idler roller is large and the contacting nip region when the idler roller is in contact with the drive roller with which the idler roller forms a pair is small, it is possible to insure sufficient transport force in the paper transport direction, and paper can be reliably discharged to the discharge portion. On the other hand, when staple processing is performed, because a paper batch must be discharged to the discharge portion, the hardness of the outer circumferential portion of the idler roller is reduced to enlarge the contacting nip region when the idler roller is in contact with the drive roller with which the idler roller forms a pair, so that it is possible to insure a large transport force in the paper transport direction and reliably discharge a paper batch to the discharge portion.

Also, in the image forming apparatus of the present invention, a configuration may be adopted in which the drive roller and a plurality of the idler rollers provided in the discharge roller portion are also used as shifter rollers that perform shifter processing. Shifter processing sorts paper by shifting the discharge position of the paper in the widthwise direction of the paper with the discharge portion, by discharging paper to the discharge portion from a plurality of positions in the widthwise direction of the paper.

In this manner, by also using the rollers of the discharge roller portion as shifter rollers, it is possible to achieve a reduction in the number of components, a reduction in cost, a more compact size for the apparatus, and the like. Also, disposing the rollers used for paper discharge such that they can be put in contact or separated gives rise to the following sort of merits. Conventionally, a configuration is adopted in which, when discharge rollers have been used as shifter rollers, shifter processing is not performed when staple processing has been performed. That is, because the discharge rollers cannot be put in contact or separated, the shifter function of the discharge rollers is only applicable to one page of paper for which staple processing has not been performed, and is not applicable to a paper batch for which staple processing has been performed. On the other hand, as described above, by disposing the rollers used for paper discharge such that they can be put in contact or separated, after staple processing, by putting the drive roller and the idler roller with which it forms a pair in a contact state, it is possible to reliably chuck a paper batch after staple processing, and shifter processing can be performed in this state. Thus, it is possible to likewise perform shifter processing for either one page of paper for which staple processing has not been performed, or a paper batch for which staple processing has been performed.

DESCRIPTION OF THE PREFERRED EMBODIMENTS

Hereinafter, embodiments of the present invention will be described with reference to the accompanying drawings, as an aid to understanding the present invention. The following embodiment is a specific example of the present invention, and is not of a nature limiting the technological scope of the present invention.

Figure 1:
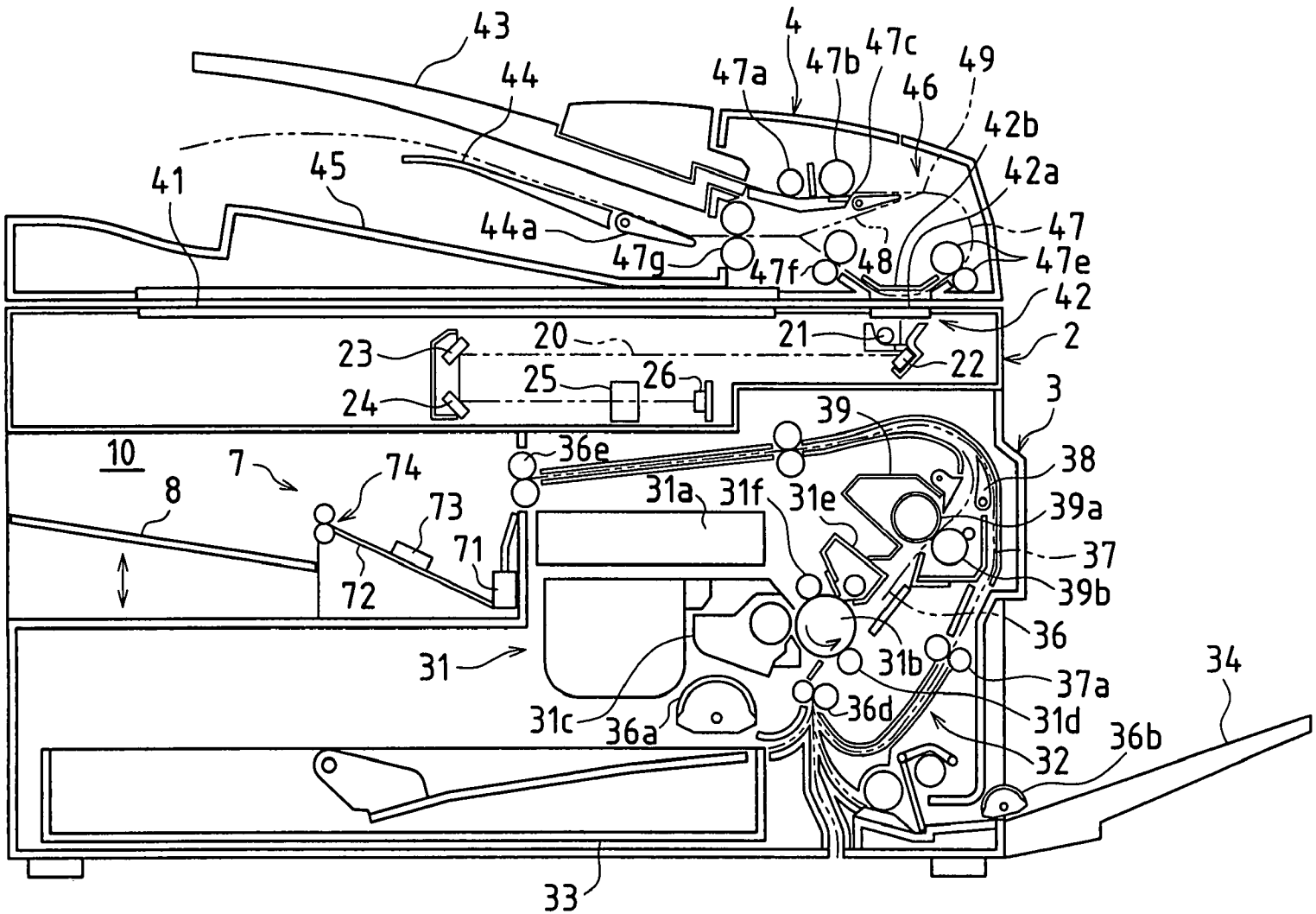
FIG. 1 shows the schematic structure of a multifunction machine in which the present invention is applied.

In the present embodiment, a case is explained in which an image forming apparatus provided with the paper post-processing apparatus of the present invention is applied in a multifunction machine. FIG. 1 shows an overview of the internal configuration of such a multifunction machine. A multifunction machine 1 is configured as an image forming apparatus using a built-up system. Specifically, the multifunction machine 1 has a configuration in which an original reading means is disposed in the upper portion of the apparatus main body, a feed means is disposed in the lower portion of the apparatus main body, and a print means is disposed between the original reading means and the feed means.

As shown in FIG. 1, the multifunction machine 1 includes a scanner portion 2 as the original reading means, an image forming portion 3, an automatic original feed portion 4, and a paper post-processing portion 7 as the paper post-processing means. Also, for the sake of convenience, the portions in the multifunction machine 1 other than the paper post-processing portion 7 and a discharge tray 8 are referred to as the "apparatus main body".

This multifunction machine 1 has a copier mode, printer mode, and fax mode as image forming modes in which an image is formed on paper (including recording media for overhead projectors and the like), and the modes are selected by a user. For example, after operating condition input keys (number of pages to print, print magnification, etc.) that have been provided in an operating panel (not shown in the figure) disposed on the outer front face portion of the multifunction machine 1, an copy operation is started when a start key is operated.

Following is a description of each portion of the multifunction machine 1.

<Scanner Portion 2>

First is a description of the scanner portion 2. The scanner portion 2 reads an image of an original that has been placed on an original stage 41 made from transparent glass or the like, or an image of originals supplied page by page from the automatic original feed portion 4, and creates image data. This scanner portion 2 includes an exposing light source 21, a plurality of reflecting mirrors 22, 23, and 24, an imaging lens 25, and a photoelectric transducer (CCD: Charge Coupled Device) 26.

The exposing light source 21 irradiates light to an original that has been placed on the original stage 41 of the automatic original feed portion 4 or an original that is transported through the automatic original feed portion 4. As indicated by an optical path 20 shown in FIG. 1, the reflecting mirrors 22, 23, and 24 once reflect reflected light from the original in the leftward direction in FIG. 1, then reflect that light downward, then reflect that light in the rightward direction in FIG. 1 towards the imaging lens 25.

There are the following two original image reading operations. On the one hand, when reading an original that has been placed on the original stage 41 (when used as a "stationary sheet system"), the exposing light source 21 and the reflecting mirrors 22, 23, and 24 scan in the horizontal direction along the original stage 41, and read an image of the entire original. On the other hand, when reading an original that is transported through the automatic original feed portion 4 (when used as a "moving sheet system"), the exposing light source 21 and the reflecting mirrors 22, 23, and 24 are fixed in the position shown in FIG. 1, and when the original passes an original reading portion 42 of the automatic original feed portion 4 described below, an image of that original is read.

Light that has been reflected by the reflecting mirrors 22, 23, and 24 and has passed the imaging lens 25 is guided to the photoelectric transducer 26, and in this photoelectric transducer 26 the reflected light is converted to an electrical signal (original image data).

<Image Forming Portion 3>

Following is a description of the image forming portion 3. The image forming portion 3 includes an image forming system 31 as a print means, and a paper transport system 32.

The image forming system 31 includes a laser scanning unit 31*a* and a photosensitive drum 31*b* as a drum-type image carrier. The laser scanning unit 31*a* irradiates the surface of the photosensitive drum 31*b* with laser light based on the original image data that has been converted in the photoelectric transducer 26, or image data that has been input from an external terminal apparatus or the like. The photosensitive drum 31*b* rotates in the direction indicated by the arrow in FIG. 1, and by laser light from the laser scanning unit 31*a* being irradiated, an electrostatic latent image is formed on the surface of the photosensitive drum 31*b*.

Other than the laser scanning unit 31*a*, a development unit 31*c*, an unshown transfer unit having a transfer roller 31*d*, a cleaning unit 31*e*, an unshown charge removal unit, and an unshown charging unit having a charging roller 31*f* are disposed in order in the circumferential direction around the outer circumference of the photosensitive drum 31*b*.

The development unit 31*c* develops the electrostatic latent image that has been formed on the surface of the photosensitive drum 31*b* into a visible image with toner (manifesting agent). The transfer roller 31*d* transfers the toner image that has been formed on the surface of the photosensitive drum 31*b* to paper as a recording medium. The cleaning unit 31*e* removes toner remaining on the surface of the photosensitive drum 31*b* after toner transfer. The charge removal unit removes an electrical charge remaining on the surface of the photosensitive drum 31*b*. The charging roller 31*f* charges the surface of the photosensitive drum 31*b* to a predetermined potential before an electrostatic latent image is formed.

When forming an image on paper, the surface of the photosensitive drum 31*b* is charged to a predetermined potential by the charging roller 31*f*, and the laser scanning unit 31*a* irradiates laser light based on the original image data to the surface of the photosensitive drum 31*b*. Afterwards, the development unit 31*c* develops a visible image on the surface of the photosensitive drum 31*b* with toner, and a toner image is transferred to the paper by the transfer roller 31*d*. Afterwards, the toner remaining on the surface of the photosensitive drum 31*b* is removed by the cleaning unit 31*e*, and the electrical charge remaining on the surface of the photosensitive drum 31*b* is removed by the charge removal unit. By doing so, one cycle of the operation that forms an image on the paper (print operation) is concluded. By repeating this cycle, it is possible to successively form images on a plurality of pages of paper.

On the other hand, the paper transport system 32 allows image formation by the image forming system 31 to be performed by transporting paper housed in the paper cassette 33 as a feed means or paper placed in the manual tray 34 page by page, and discharges paper for which image formation has been performed to the discharge tray 8 as a discharge portion, via the paper post-processing portion 7, described below. The discharge tray 8 is provided above the paper cassette 33 and below the scanner portion 2.

The paper transport system 32 is provided with a main transport path 36 and a reverse transport path 37 inside the apparatus main body. In the paper transport system 32, paper is transported through the paper transport system 32 with a so-called center reference. That is, the paper is transported with the center position of the paper in the widthwise direction (the direction perpendicular to the paper transport direction) used as a reference.

One end of the main transport path 36 is branched into two, with one branch end facing the discharge side of the paper cassette 33 and the other branch end facing the discharge side of the manual tray 34. The other end of the main transport path 36 faces the paper post-processing portion 7. One end of the reverse transport path 37 is connected to the main transport path 36 on the side upstream (below, in FIG. 1) from the position where the transfer roller 31*d* is disposed, and the other end is connected to the main transport path 36 on the side downstream (above, in FIG. 1) from the position where the transfer roller 31*d* is disposed.

A pickup roller 36*a* with a semicircular-shaped cross section is disposed at one branch end (the portion facing the discharge end of the paper cassette 33) of the main transport path 36. Due to rotation of this pickup roller 36*a*, it is possible to intermittently feed the paper housed in the paper cassette 33 page by page to the main transport path 36. Likewise, a pickup roller 36*b* with a semicircular-shaped cross section is disposed at the other branch end (the portion facing the discharge end of the manual tray 34) of the main transport path 36. Due to rotation of this pickup roller 36*b*, it is possible to intermittently feed the paper placed in the manual tray 34 page by page to the main transport path 36.

Registration rollers 36*d* are disposed on the side upstream from the position where the transfer roller 31*d* is disposed in this main transport path 36. These registration rollers 36*d* transport paper while matching the positions of the paper and the toner image on the surface of the photosensitive drum 31*b*.

On the downstream side of the position at which the transfer roller 31*d* is disposed in the main transport path 36, a fixing unit 39 is disposed that is provided with a pair of rollers including a hot roller 39*a* and a pressure roller 39*b* for fixing the toner image transferred to the paper with heat. Further, at the downstream end of the main transport path 36, discharge rollers 36*e* are disposed for discharging the paper to a staple processing stage 72 of the paper post-processing portion 7.

A branch catch 38 is disposed at the position connecting the upstream end of the reverse transport path 37 to the main transport path 36. This branch catch 38 is rotatable around a horizontal axis between a "paper discharge position" in FIG. 1 (the position shown by a solid line in FIG. 1) and a "paper reversal position" that opens the reverse transport path 37 by rotating from the "paper discharge position" in the counterclockwise direction in FIG. 1. When this branch catch 38 is in the "paper discharge position", the paper is transported toward the discharge rollers 36*e*, and when the branch catch 38 is in the "paper reversal position", the paper can be supplied to the reverse transport path 37.

The reverse transport path 37 is used when forming an image on the rear face of the paper. When printing on the rear face, in the main transport path 36, when paper for which image formation on the front face has finished is transported from the branch catch 38 to the discharge rollers 36*e*, the discharge rollers 36*e* are rotated in reverse with the trailing edge portion of that paper chucked by the discharge rollers 36*e*. Thus, the paper is reversed, and now transported from the discharge rollers 36*e* toward the branch catch 38, and further, conducted to the branch catch 38 in the "paper reversal position" and guided to the reverse transport path 37. Then, the paper is transported by transport rollers 37*a* disposed in the reverse transport path 37, introduced to the main transport path 36 on the upstream side of the registration rollers 36*d*, and again transported through the main transport path 36 toward the transfer roller 31*d*. In this manner, it is possible to form an image on the rear face of the paper. Paper for which image formation on the rear face has finished is discharged from the discharge rollers 36*e* to the staple processing stage 72 of the paper post-processing portion 7.

<Automatic Original Feed Portion 4>

Following is a description of the automatic original feed portion 4. The automatic original feed portion 4 is configured as a so-called automatic duplex original transport apparatus. This automatic original feed portion 4 can be used as a moving sheet system, and includes an original tray 43 as an original placement portion, a middle tray 44, an original discharge tray 45 as an original discharge portion, and an original transport system 46 that transports an original between the trays 43, 44, and 45.

The original transport system 46 is provided with a main transport path 47 for transporting an original that has been placed on the original tray 43 to the middle tray 44 or the original discharge tray 45 via an original reading portion 42, and a sub transport path 48 for feeding an original on the middle tray 44 to the main transport path 47.

An original pickup roller 47*a* and a separation roller 47*b* are disposed at the upstream end (the portion facing the discharge side of the original tray 43) of the main transport path 47. A separation plate 47*c* is disposed on the bottom side of the separation roller 47*b*. With rotation of the original pickup roller 47*a*, one page of the originals on the original tray 43 is supplied to the main transport path 47 by passing between the separation roller 47*b* and the separation plate 47*c*. PS rollers 47*e* are disposed on the downstream side of a linking portion 49 of the main transport path 47 and the sub transport path 48. These PS rollers 47*e* adjust the leading edge of the original and the image reading timing of the scanner portion 2, and feed the original to the original reading portion 42. That is, the PS rollers 47*e* temporarily stop transport of the original with the original in a supplied state, adjust the above timing, and feed the original to the original reading portion 42.

The original reading portion 42 is provided with a glass platen 42*a* and an original pressing plate 42*b*, and when the original supplied from the PS rollers 47*e* passes between the glass platen 42*a* and the original pressing plate 42*b*, light from the exposing light source 21 passes through the glass platen 42*a* and is irradiated onto the original. At this time, the acquisition of original image data by the scanner portion 2 is performed. Biasing force is conferred on the back face (top face) of the original pressing plate 42*b* by a coil spring not shown in the figure. Thus, the original pressing plate 42*b* is in contact with the glass platen 42*a* with a predetermined pressure, and when the original passes the original reading portion 42, the original is prevented from rising up from the glass platen 42*a*.

Transport rollers 47*f* and original discharge rollers 47*g* are provided on the downstream side of the glass platen 42*a*. A configuration is adopted in which an original that has passed above the glass platen 42*a* is discharged to the middle tray 44 or the original discharge tray 45 via the transport rollers 47*f* and the original discharge rollers 47*g*.

A middle tray swing plate 44*a* is disposed between the original discharge rollers 47*g* and the middle tray 44. This middle tray swing plate 44*a* swings centered on the edge portion of the middle tray 44 side, and can swing between a "normal position" (shown by a solid line) and a "flipped up position" flipped upward from the "normal position". When the middle tray swing plate 44*a* is in the "flipped up position", an original that has been discharged from the original discharge rollers 47*g* is recovered to the original discharge tray 45. On the other hand, when the middle tray swing plate 44*a* is in the "normal position", an original that has been discharged from the original discharge rollers 47*g* is discharged to the middle tray 44. When discharging to this middle tray 44, the marginal edge of the original is in a state sandwiched between the original discharge rollers 47*g*, the original is supplied to the sub transport path 48 by the reverse rotation of the original discharge rollers 47*g* from this state, and the original is again fed out to the main transport path 47 via this sub transport path 48. This reverse rotation operation of the original discharge rollers 47*g* is performed after adjusting the timing for feeding out the original to the main transport path 47 and the image reading. Thus, an image of the rear face of the original is read by the original reading portion 42.

<Paper Post-Processing Portion 7 and Discharge Tray 8>

Following is a description of the paper post-processing portion 7 and the discharge tray 8.

The paper post-processing portion 7 makes it possible to perform at least staple processing, as paper post-processing, for paper discharged from the apparatus main body after print processing is finished. That is, the paper post-processing portion 7 is provided with at least a staple function. In this example, as described below, the paper post-processing portion 7 is provided with a shifter function in addition to the staple function. However, a configuration may also be adopted in which other functions are provided (such as a hole-punching function, for example). The paper post-processing in such a paper post-processing portion 7 is, as described below, performed when there has been a request for paper post-processing as a print condition when a print request has been made.

To the discharge tray 8, paper for which paper post-processing such as staple processing or shifter processing has been performed in the paper post-processing portion 7 is discharged. The discharge tray 8 may be configured as a tray that can move up or down, and it may also be configured as a tray that can be extended or withdrawn in the paper transport direction (paper discharge direction). By providing the discharge tray 8 such that it can be extended or withdrawn in the paper transport direction, the discharge tray can be used adjusted to an optimum length for the printing paper size.

In this example, the paper post-processing portion 7 and the discharge tray 8 are not provided outside of the apparatus main body of the multifunction machine 1; they are provided using a space 10 formed by the apparatus main body. That is, the paper post-processing portion 7 is provided as a so-called inner finisher. Specifically, the apparatus main body of the multifunction machine 1 adopts a configuration in which the paper cassette 33, the image forming portion 3 (the image forming system 31), and the scanner portion 2 are disposed in approximately the shape of a sideways U open to the left side, and the paper post-processing portion 7 and the discharge tray 8 are provided in the internal U-shaped space 10 formed by this apparatus main body. Thus, it is possible to provide the paper post-processing portion 7 and the discharge tray 8 in a limited space within the multifunction machine 1, and a plurality of types of paper post-processing can be performed for the paper. Also, the area occupied by the multifunction machine 1 provided with the paper post-processing portion 7 is suppressed and it is possible to achieve space conservation. Accordingly, it is not necessary to provide a paper post-processing portion outside of the apparatus main body even if the multifunction machine 1 uses a front access system and a built-up system, and demands for compactness can be satisfied.

<Details of Paper Post-Processing Portion 7>

Following is a detailed description of the paper post-processing portion 7.

As shown in FIG. 1, the paper post-processing portion 7 is disposed on the downstream side of the discharge rollers 36*e* of the apparatus main body. In the paper post-processing portion 7, staple processing can be performed for paper for which printing is finished that is transported from the discharge rollers 36*e*. Shifter processing can be performed with a discharge roller portion 74 provided in the paper post-processing portion 7, as described below. The discharge tray 8 is provided on the downstream side of the paper post-processing portion 7.

The paper post-processing portion 7 includes a staple mechanism portion 71, a staple processing stage 72, adjusting plates 73, the discharge roller portion 74, and the like. In the paper post-processing portion 7, when there has been a request for staple processing as a print condition when a print request has been made, staple processing is performed by the staple mechanism portion 71 for a predetermined number of pages stacked on the staple processing stage 72. A configuration is adopted in which at this time, staple processing is performed at a position determined based on the printing paper size and a desired staple position. The desired staple position is a position at which a user's desired staple processing is performed, such as fastening at one location in the upper left corner portion of the paper or fastening at two locations in the left edge portion, for example.

The staple mechanism portion 71 is disposed below the discharge rollers 36*e*, and binds the trailing edge portion of paper stacked on the staple processing stage 72 with staples. The staple mechanism portion 71 is configured so that it can move back and forth in the widthwise direction of the paper, and staple processing can be performed at a position determined based on the above-mentioned printing paper size and desired staple position. When performing staple processing with the paper post-processing portion 7, the staple mechanism portion 71 is moved to a position that corresponds to the position determined based on the above-mentioned printing paper size and desired staple position.

Paper discharged from the discharge rollers 36*e* is stacked on the staple processing stage 72, and the staple processing stage 72 fulfills a role as the processing stage when staple processing is performed by the staple mechanism portion 71. The staple processing stage 72 is disposed with the downstream side in the paper transport direction sloped upward. When staple processing is performed, the paper discharged from the discharge rollers 36*e* slides along the slope of the staple processing stage 72 to the upstream side in the paper transport direction due to the paper's own weight. On the other hand, when staple processing is not performed, as described below, the paper is discharged from the discharge roller portion 74 to the discharge tray 8. Also, as described below, the rollers of the discharge roller portion 74 are in a separated state during staple processing.

The adjusting plates 73 are disposed facing each other on both sides of the top face of the staple processing stage 72 (the face on which the paper is discharged) in the widthwise direction of the paper. The pair of adjusting plates 73 are disposed such that they can move back and forth in the widthwise direction of the paper. When staple processing is performed with the paper post-processing portion 7, by moving the adjusting plates 73 in the widthwise direction of the paper, adjustment in the widthwise direction is performed for each page of paper discharged onto the staple processing stage 72. A configuration is adopted in which at this time, the adjusting plates 73 are moved according to a movable width determined based on the printing paper size, that is, based on the size of the paper to be transported.

The back and forth movement of the pair of adjusting plates 73 is, for example, possible with a rack and pinion mechanism. Specifically, a rack member linked to one of the adjusting plates 73 and another rack member linked to the other adjusting plate 73 are disposed facing each other at a predetermined interval. A pinion gear is disposed between the two rack members and engages both respective rack members. Here, the rack members are disposed such that they can move back and forth in the widthwise direction of the paper, while the pinion gear is disposed such that it cannot move. By rotating the pinion gear by transmitting power from a drive source, the pair of adjusting plates 73 are moved symmetrically in the widthwise direction of the paper. Thus, adjustment in the widthwise direction of the paper discharged onto the staple processing stage 72 is possible.

The discharge roller portion 74 has a configuration in which the roller used for paper discharge is selectively switched according to the processing contents of the paper post-processing portion 7, in this case, specifically depending on whether or not staple processing is performed in the paper post-processing portion 7. Also, the discharge roller portion 74 is configured so that the rollers used for paper discharge can be put in contact or separated when staple processing is performed. Following is a detailed description with reference to FIGS. 2(*a*) to 4(*b*).

Figure 2:
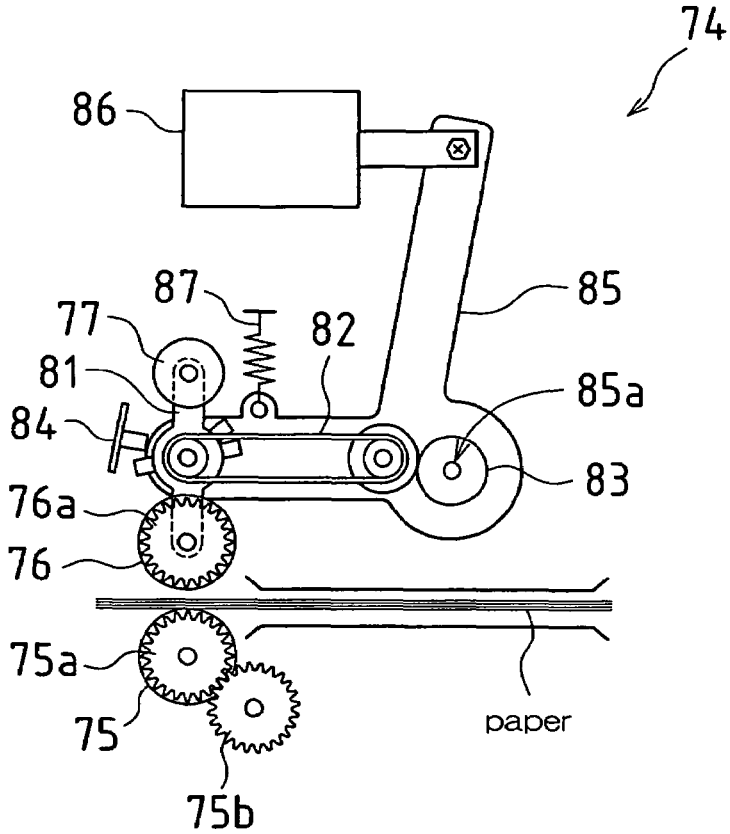
FIGS. 2(*a*) and 2(*b*) show a discharge roller portion during staple processing.
Figure 2:
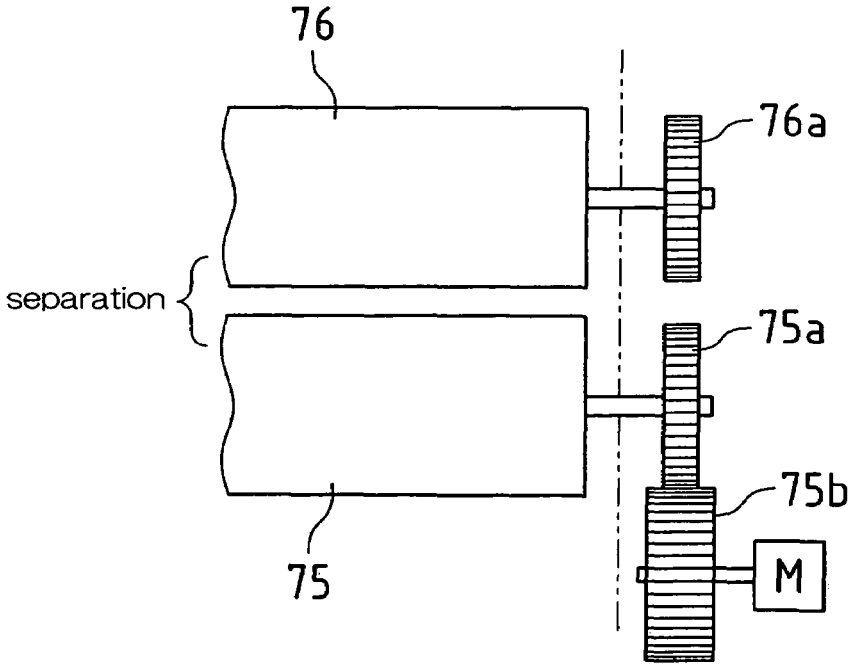
Figure 3:
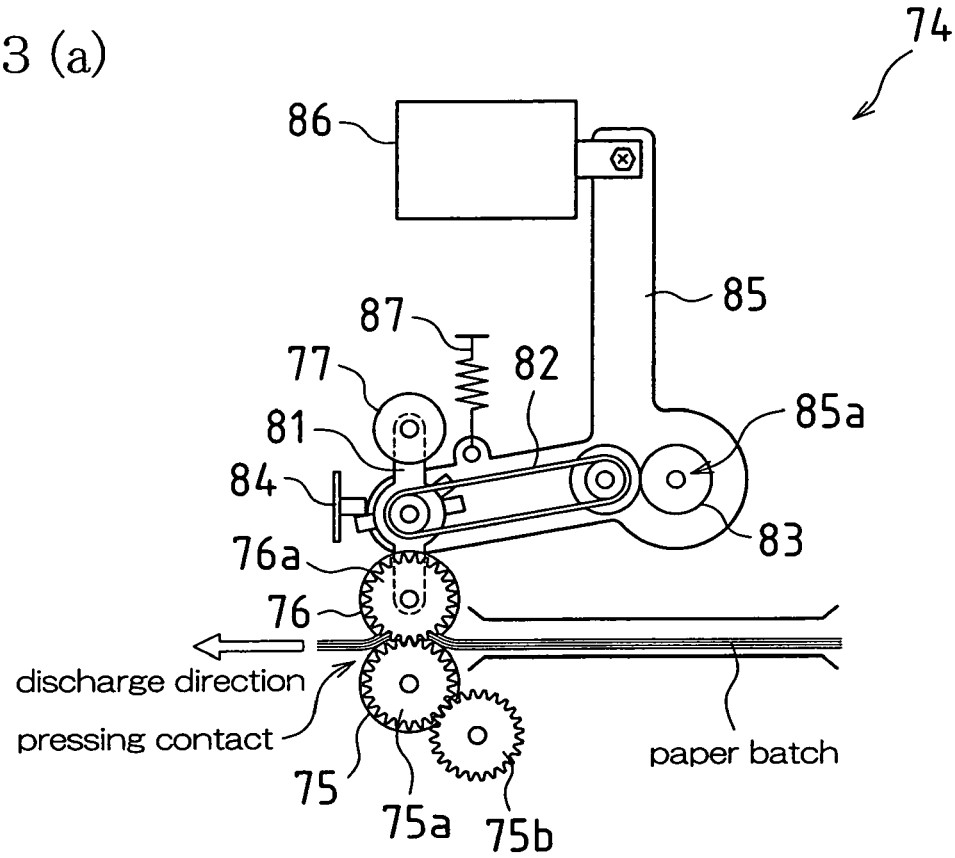
FIGS. 3(*a*) and 3(*b*) show the discharge roller portion after staple processing.
Figure 3:
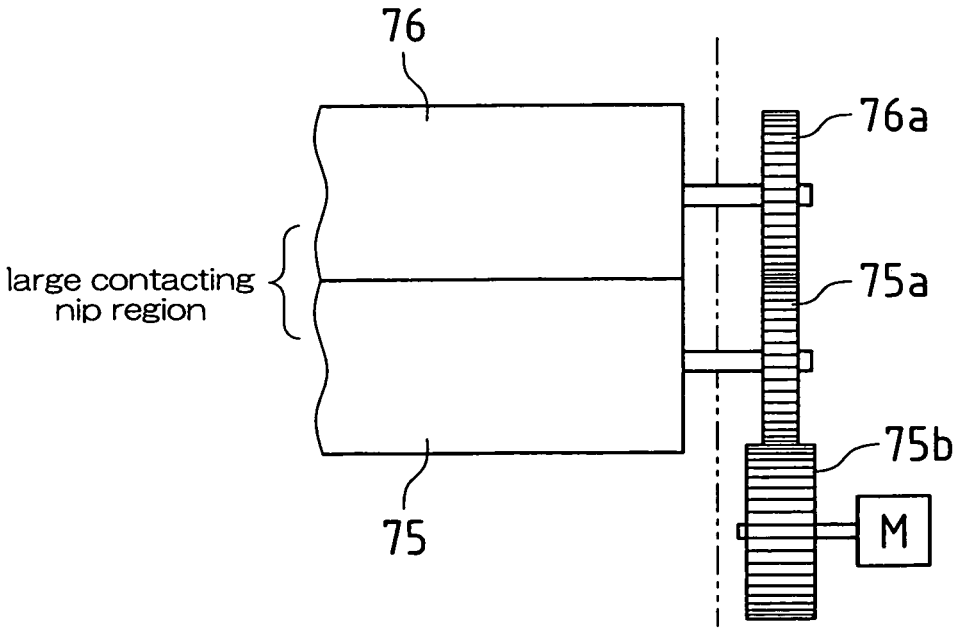
Figure 4:
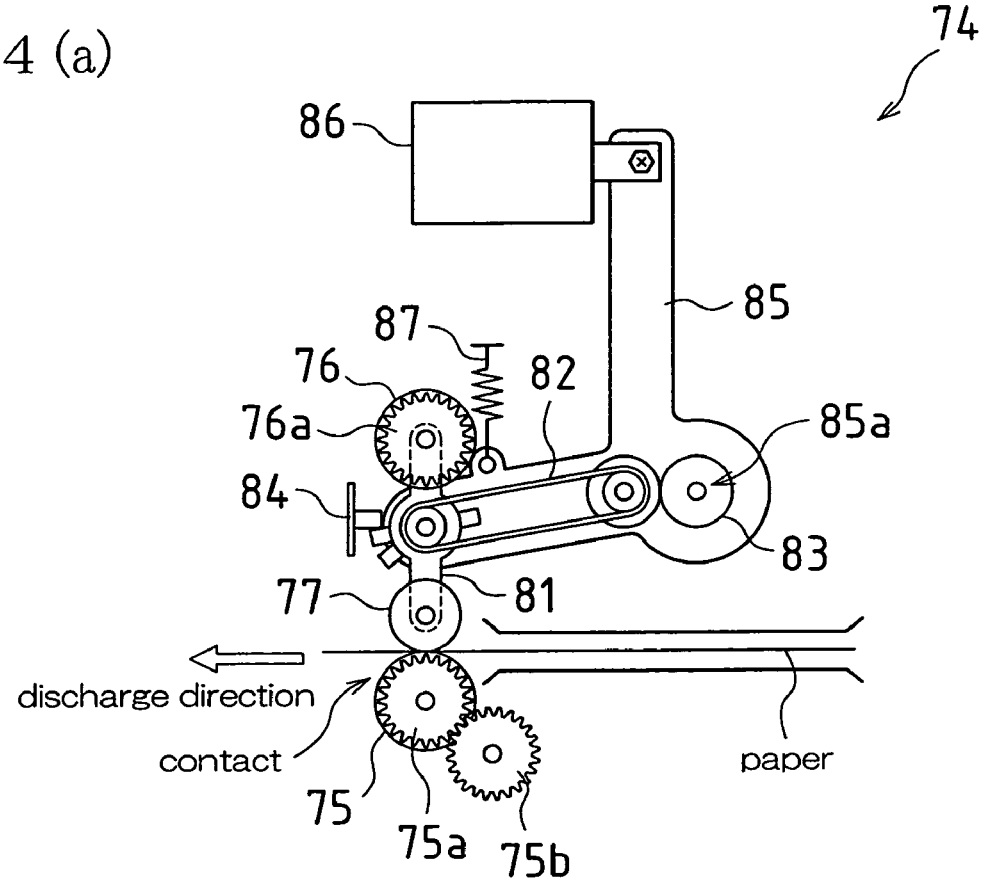
FIGS. 4(*a*) and 4(*b*) show the discharge roller portion when staple processing is not performed.
Figure 4:
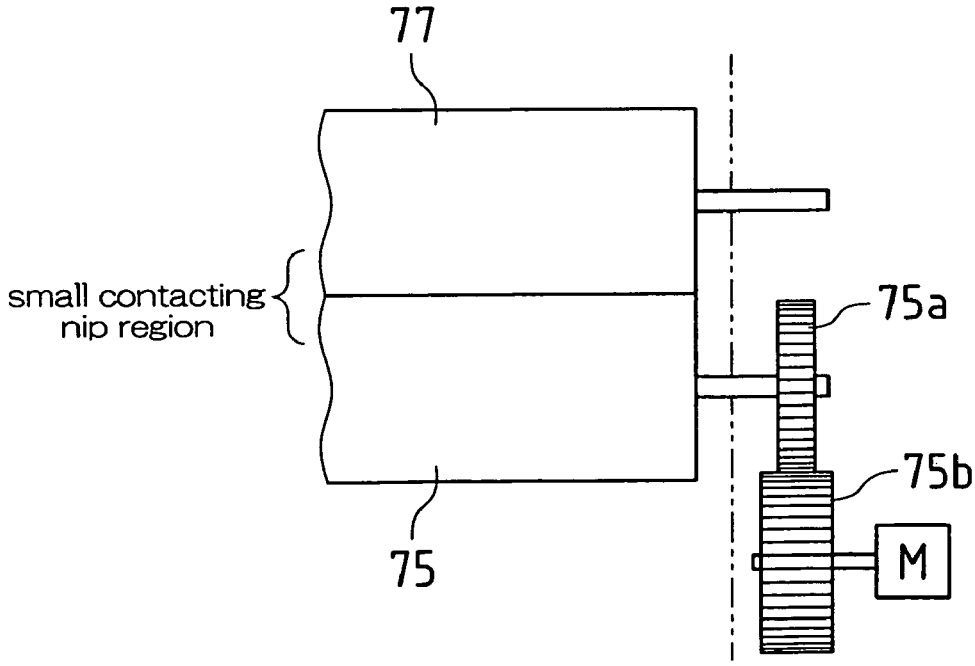

FIGS. 2(*a*) and 2(*b*) show the discharge roller portion 74 during staple processing. FIG. 2(*a*) shows the structure of the discharge roller portion 74, and FIG. 2(*b*) shows a drive roller 75 and a first idler roller 76 in a separated state. FIGS. 3(*a*) and 3(*b*) show the discharge roller portion 74 after staple processing. FIG. 3(*a*) shows the structure of the discharge roller portion 74, and FIG. 3(*b*) shows the drive roller 75 and the first idler roller 76 in a contact state. FIGS. 4(*a*) and 4(*b*) show the discharge roller portion 74 when staple processing is not performed. FIG. 4(*a*) shows the structure of the discharge roller portion 74, and FIG. 4(*b*) shows the drive roller 75 and a second idler roller 77 in a contact state.

The discharge roller portion 74 is configured from the drive roller 75, the first idler roller 76, the second idler roller 77, an idler roller holder 81, an idler roller holder rotation belt 82, an idler roller holder rotation motor gear 83, an idler roller holder position detection sensor 84, an idler roller pressure arm 85, a pressure arm drive solenoid 86, a pressure arm return spring 87, and the like. Except for the drive roller 75, the first idler roller 76, and the second idler roller 77, the constituent members of the discharge roller portion 74, are housed within the front side or far side of the space 10 in the apparatus main body.

The drive roller 75 is disposed on the furthest downstream side in the paper transport direction of the staple processing stage 72, such that it faces the discharge tray 8. The drive roller 75 is one of the rollers that discharge paper on the staple processing stage 72 to the discharge tray 8. When discharging paper, either the first idler roller 76 or the second idler roller 77 makes contact with the drive roller 75. A gear 75*a* is disposed at one end of a roller shaft of the drive roller 75 as a drive portion (a drive roller side drive portion). The gear 75*a* is linked to a drive source M via a gear 75*b* or the like, and the drive roller 75 can be rotationally driven by the power of the drive source M.

The first idler roller 76 and the second idler roller 77 are rotatably supported at both end portions of the idler roller holder 81. The first idler roller 76 is used when discharging paper to the discharge tray 8 after staple processing, and makes contact with the drive roller 75. On the other hand, the second idler roller 77 is used when discharging paper to the discharge tray 8 without performing staple processing, and makes contact with the drive roller 75. In this manner, two rollers that form a pair with the drive roller 75 and can be selectively used when discharging paper to the discharge tray 8 are provided in the discharge roller portion 74.

The outer circumferential portion of the first idler roller 76 is formed from, for example, foam rubber, soft rubber, or the like. The outer circumferential portion of the second idler roller 77 is formed from material with a higher degree of hardness than the outer circumferential portion of the first idler roller 76, such as POM (Polyoxymethylene), for example. The gear 76*a* is provided fixed at one end of the roller shaft of the first idler roller 76. The gear 76*a* engages the gear 75*a* of the drive roller 75 when the first idler roller 76 has made contact with the drive roller 75. This gear 76*a* fulfills the role of a drive portion (an idler roller side drive portion) that actively rotates the first idler roller 76. On the other hand, a gear is not disposed in the end portion of the roller shaft of the second idler roller 77.

Switching of the roller that makes contact and forms a pair with the drive roller 75, that is, switching of the roller used for paper discharge, is performed by rotation of the idler roller holder 81, which is rotatably supported by the idler roller pressure arm 85. The idler roller holder rotation motor gear 83 drives, and thus its power is transmitted via the idler roller holder rotation belt 82, rotating the idler roller holder 81. The idler roller holder 81 rotates such that it switches between a first position where the first idler roller 76 faces the drive roller 75 (the position shown in FIGS. 2(*a*) to 3(*b*)) and a second position where the second idler roller 77 faces the drive roller 75 (the position shown in FIGS. 4(*a*) and 4(*b*)). The idler roller holder 81 switches between the first position and the second position at each 180 degrees that the idler roller holder 81 rotates. The idler roller holder position detection sensor 84 is provided in the vicinity of the idler roller holder 81 in order to detect the position of the idler roller holder 81.

The idler roller pressure arm 85 is an approximately L-shaped member. The idler roller holder 81 is supported at one end of that L-shape. Also, the pressure arm return spring 87 is provided at the one end of the L-shape. On the other hand, the pressure arm drive solenoid 86 is linked to the other end of the L-shape. The idler roller pressure arm 85 rotates around a rotational fulcrum 85*a* such that the idler roller pressure arm 85 switches between a contact position (the position shown in FIGS. 3(*a*) to 4(*b*)) where the first idler roller 76 or the second idler roller 77 makes contact with the drive roller 75, and a separation position (the position shown in FIGS. 2(*a*) and 2(*b*)) where the first idler roller 76 separates from the drive roller 75. Specifically, when the pressure arm drive solenoid 86 drives, as shown in FIGS. 3(*a*) to 4(*b*), the idler roller pressure arm 85 rotates against the biasing force of the pressure arm return spring 87 to the contact position, and conversely, when the pressure arm drive solenoid 86 stops, as shown in FIGS. 2(*a*) and 2(*b*), the idler roller pressure arm 85 rotates to the separation position due to the biasing force of the pressure arm return spring 87.

<Paper Discharge to Discharge Tray 8 By Discharge Roller Portion 74>

Following is a description of paper discharge to the discharge tray 8 by the discharge roller portion 74.

Starting from its leading edge, the paper discharged toward the staple processing stage 72 from the discharge rollers 36*e* after print processing is finished gradually makes contact with the staple processing stage 72. Then, while the paper is being discharged from the discharge rollers 36*e*, the leading edge portion of the paper arrives at the discharge roller portion 74 on the furthest downstream side of the staple processing stage 72. Subsequent transport of the paper varies depending on whether or not staple processing is performed by the paper post-processing portion 7.

When staple processing is not performed by the paper post-processing portion 7, the discharge roller portion 74 is in the state shown in FIGS. 4(*a*) and 4(*b*). Specifically, the idler roller holder 81 rotates and is switched to the second position, and the idler roller pressure arm 85 rotates and is switched to the contact position. As a result, in the discharge roller portion 74, the second idler roller 77 is in contact with the drive roller 75. At this time, the outer circumferential portion of the second idler roller 77 is formed with a material that has a higher degree of hardness than the outer circumferential portion of the first idler roller 76, and the contacting nip region (nip width) of the second idler roller 77 and the drive roller 75 is smaller than in the case of contact between the first idler roller 76 and the drive roller 75, which will be described below.

When the drive roller 75 rotationally drives, the second idler roller 77 idly rotates. Thus, paper is transported by the drive roller 75 and the second idler roller 77, and is discharged to the discharge tray 8. At this time, when there has been a request for shifter processing as a print condition when a print request has been made, paper is discharged to the discharge tray 8 after shifter processing, described below. When staple processing is not performed, because paper is discharged to the discharge tray 8 page by page, it is possible to adequately insure transport force in the paper transport direction even if the contacting nip region is small, and paper can be reliably discharged to the discharge tray 8.

On the other hand, when staple processing is performed by the paper post-processing portion 7, the discharge roller portion 74 is first in the state shown in FIGS. 2(*a*) and 2(*b*) during staple processing. Specifically, the idler roller holder 81 rotates and is switched to the first position, and the idler roller pressure arm 85 rotates and is switched to the separation position. As a result, in the discharge roller portion 74, the first idler roller 76 is separated from, and faces, the drive roller 75. At this time, as shown in FIG. 2(*b*), the gear 76*a* is not engaged with the gear 75*a*. Thus, during staple processing, even if the leading edge portion of the paper is transported between the first idler roller 76 and the drive roller 75 by the discharge rollers 36*e*, the paper is not transported by the rollers 75 and 76. Accordingly, when the trailing edge of the paper separates from the discharge rollers 36*e* and transport force to the downstream side in the paper transport direction is lost, due to its own weight the paper now slides down along the slope of the staple processing stage 72 to the upstream side in the paper transport direction. As a result, adjustment of the paper transport direction relative to the paper is performed. Then, after a predetermined number of pages of paper are discharged from the discharge rollers 36*e* and adjusted and stacked on the staple processing stage 72, staple processing is performed by the staple mechanism portion 71 at the trailing edge portion of the paper. During this staple processing, the midway portion of the paper is between the first idler roller 76 and the drive roller 75, which are in a separated state.

After staple processing is finished, the discharge roller portion 74 is in the state shown in FIGS. 3(*a*) and 3(*b*). Specifically, with the idler roller holder 81 in the first position, the idler roller pressure arm 85 rotates and is in a state switched to the contact position. As a result, in the discharge roller portion 74, the first idler roller 76 makes contact with the drive roller 75, and as shown in FIG. 3(*b*), the gear 76*a* is engaged with the gear 75*a*. At this time, the outer circumferential portion of the first idler roller 76 is formed with a material that has a lower degree of hardness than the outer circumferential portion of the second idler roller 77, and the contacting nip region of the first idler roller 76 and the drive roller 75 is larger than in the case of contact between the above second idler roller 77 and the drive roller 75 described above.

The drive roller 75 and the first idler roller 76 rotationally drive. Thus, a paper batch is transported and discharged to the discharge tray 8 by the drive roller 75 and the first idler roller 76 after staple processing. At this time, when there has been a request for shifter processing as a print condition when a print request has been made, paper is discharged to the discharge tray 8 after shifter processing, described below. A configuration is adopted in which, when staple processing is performed, in order to discharge a paper batch, in which a plurality of pages of paper have been bound, to the discharge tray 8, the contacting nip region is enlarged to insure a large transport force in the paper transport direction, so that it is possible to reliably discharge the paper batch to the discharge tray 8.

In the above manner, in the discharge roller portion 74, according to the processing contents of the paper post-processing portion 7, specifically, by adopting a configuration in which the roller used for paper discharge can be selectively switched according to the presence or absence of staple processing in the paper post-processing portion 7, it is made possible to reliably discharge paper to the discharge tray 8 with respect to either one page of paper for which staple processing has not been performed, or a paper batch of a plurality of pages for which staple processing has been performed. Likewise, it is made possible to reliably perform shifter processing.

When discharging a paper batch to the discharge tray after staple processing, by actively rotationally driving not only the drive roller 75 but also the first idler roller 76, it is possible to confer sufficient transport force in the paper transport direction even to paper that is not in contact with the drive roller 75. That is, with the active rotation of the first idler roller 76 it is possible to confer sufficient transport force in the paper transport direction to paper that is in contact with the first idler roller 76, and it is possible to confer transport force in the paper transport direction to midway paper that is not in contact with the rollers 75 and 76 via the staple portion where the paper batch is bound. Thus, when discharging the paper batch to the discharge tray 8, it is possible to prevent paper from tearing at the staple portion where the paper batch is bound.

Further, in the discharge roller portion 74, disposing the rollers used for paper discharge such that they can be put in contact or separated gives rise to merits as follows. During staple processing, the leading edge portion of paper transported to the staple processing stage 72 is made to protrude from between the drive roller 75 and the first idler roller 76 by putting the rollers 75 and 76 in a separated state. When doing so, it is possible to perform staple processing even for paper that is longer in the paper transport direction than the staple processing stage. Thus, it is possible to shorten the length of staple processing stage 72 in the paper transport direction, and a more compact paper post-processing portion 7, and by extension, a more compact multifunction machine 1, can be achieved. On the other hand, after staple processing, a paper batch is discharged to the discharge tray 8 with the rollers 75 and 76 in a contact state. Thus, the necessity of separately providing a mechanism that discharges a paper batch to a discharge portion after staple processing, such as a mechanism that pushes out a paper batch, is eliminated.

In this example, a case was described in which two idler rollers that can be selectively used when discharging paper to the discharge tray 8 and form a pair with the drive roller 75 are provided in the discharge roller portion 74, but a configuration may also be adopted in which three or more such idler rollers are provided. For example, when three idler rollers are provided, a configuration is adopted in which the three idler rollers are installed in the idler roller holder 81, and the idler roller that faces the drive roller 75 is switched between a first position, second position, and third position at each 120 degrees that the idler roller holder 81 rotates. In this manner, when the number of idler rollers is increased, it is possible to switch the idler roller used for paper discharge step-by-step according to the number of pages of paper for which staple processing is performed. By regulating the contacting nip region of the idler roller and the drive roller 75 according to the number of pages of paper for which staple processing is performed, it is possible to more reliably discharge paper to the discharge tray 8.

<Shifter Processing By Discharge Roller Portion 74>

Following is an explanation of shifter processing by the discharge roller portion 74. In this example, a configuration is adopted in which by performing shifter processing for the paper with the discharge roller portion 74, paper is discharged to the discharge tray 8 after having been sorted.

Shifter processing sorts paper by shifting the discharge position of the paper on the discharge tray 8 in the widthwise direction of the paper, by discharging paper from a plurality of positions in the widthwise direction of the paper. This kind of shifter processing becomes possible by providing the pair of rollers in the discharge roller portion 74 such that they can move back and forth in the shaft direction (in the widthwise direction of the paper). The shifter processing mechanism is widely known in the conventional technology, and so a detailed description of that mechanism is omitted.

When shifter processing is performed by a roller pair of the drive roller 75 and the second idler roller 77 (same as in the case when shifter processing is performed by a roller pair of the drive roller 75 and the first idler roller 76), the roller pair is allowed to move parallel to the shaft direction while in a state in which the paper is chucked by the roller pair of the drive roller 75 and the second idler roller 77, which are in a contact state. Thus, paper chucked by the roller pair moves in the widthwise direction of the paper. When paper is discharged to the discharge tray 8 in that position, it is possible to shift the discharge position of paper on the discharge tray 8 in the widthwise direction of the paper. By adopting this kind of configuration, for example, it is possible to sort the paper by the number of copies, and it is possible to prevent the last page of a first set of copies and the first page of a second set of copies from being discharged to the same position. In this manner, by also using the roller pair in the discharge roller portion 74 as shifter rollers, it is possible to reduce the number of components, reduce cost, realize a more compact apparatus, and the like. A configuration is adopted in which the roller pair returns to its original position after the paper is discharged.

As described above, because the rollers used for paper discharge are provided such that they can be put in contact or separated, there are the following merits. Conventionally, a configuration is adopted in which when the discharge rollers are also used as shifter rollers, shifter processing is not performed when staple processing has been performed. That is, because it is not possible for the discharge rollers to be put in contact or separated, the shifter function of the discharge rollers is only compatible with one page of paper for which staple processing has not been performed, and the shifter function is not compatible with a paper batch for which staple processing has been performed. On the other hand, in this example, by putting the drive roller 75 and the first idler roller 76 in a contact state after staple processing, the paper batch can be reliably chucked after staple processing, and shifter processing can be performed in this state. Thus, shifter processing can be likewise performed for either one page of paper for which staple processing has not been performed or for a paper batch for which staple processing has been performed.

<Operation of Discharge Roller Portion 74 During Paper Post-Processing>

Figure 5:
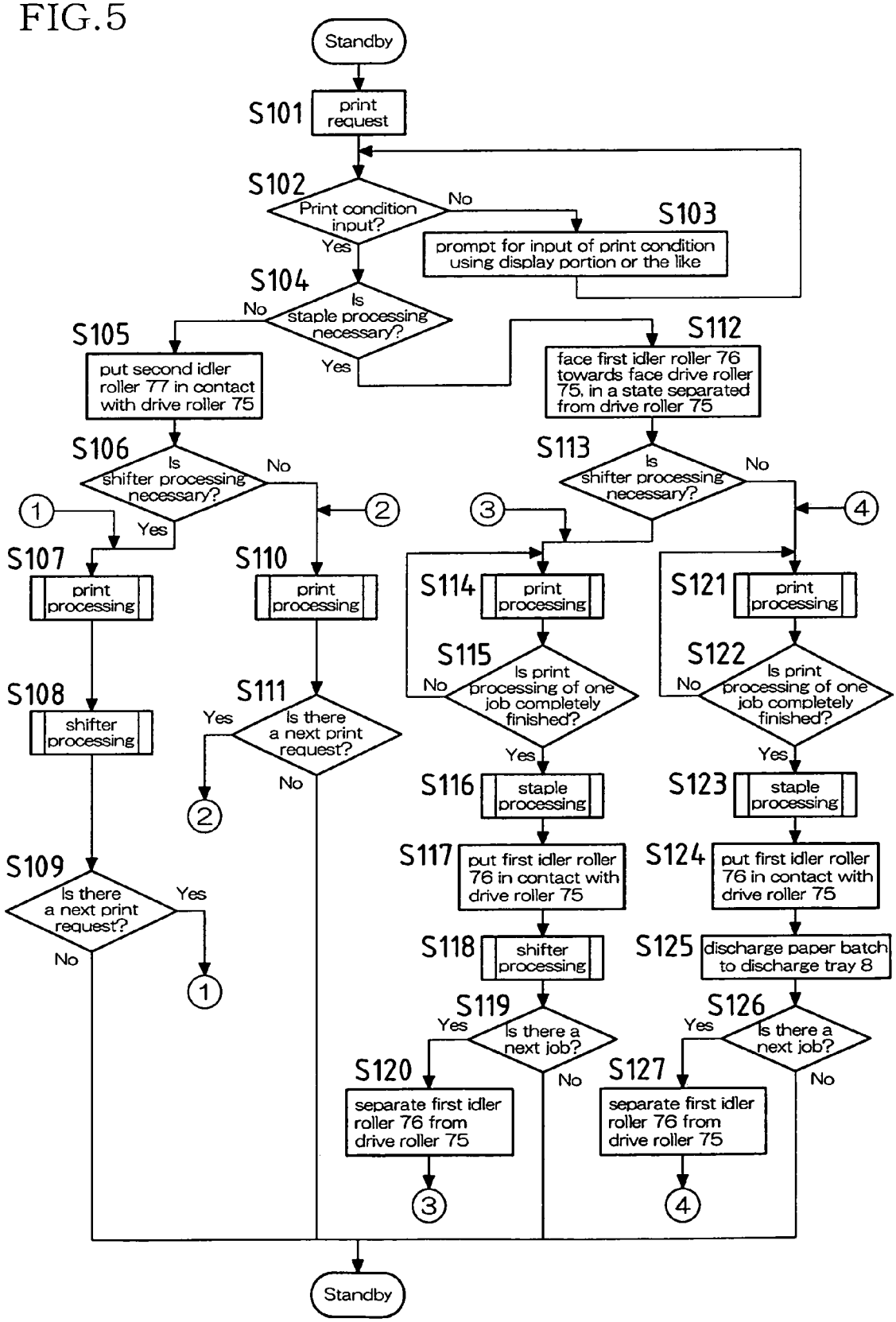
FIG. 5 is a flowchart that shows the operation of the discharge roller portion during paper post-processing in the multifunction machine.

Following is a description of the operation of the discharge roller portion 74 during paper post-processing in the multifunction machine 1, with reference to FIG. 5.

The main control body for the operation of the paper post-processing of the paper post-processing portion 7 and the discharge roller portion 74 is chiefly the control portion (not shown in the figure) of the multifunction machine 1. That is, as shown in FIG. 5, in the control portion of the multifunction machine 1, when there has been a print request (Step S110), a determination is made of whether or not the selection of print conditions has been completed (Step S102). In this case, selectable print conditions include the selection of whether or not staple processing will be performed by the paper post-processing portion 7, and the selection of whether or not shifter processing will by performed by the discharge roller portion 74. When the result of this determination is that the selection of print conditions still has not been completed, the user is prompted to select print conditions by a display on a display portion or the like (Step S103), and the operation waits until the print conditions have been selected.

Next, a determination is made of whether or not staple processing is selected as a print condition (Step S104). When staple processing has not been selected, the idler roller holder 81 is rotated to the second position by driving the idler roller holder rotation motor gear 83 of the discharge roller portion 74, and the idler roller pressure arm 85 is rotated to the contact position by driving the pressure arm drive solenoid 86. Thus, the second idler roller 77 makes contact with the drive roller 75 (Step S105).

Next, a determination is made of whether or not shifter processing is selected as a print condition (Step S106). When shifter processing has been selected, after print processing has been executed (Step S107), the paper is discharged from the discharge rollers 36*e* to the staple processing stage 72. Then, the paper is transported between the drive roller 75 and the second idler roller 77 of the discharge roller portion 74 on the furthest downstream side of the staple processing stage 72, and shifter processing is executed with the paper chucked by the drive roller 75 and the second idler roller 75, and afterwards the paper is discharged to the discharge tray 8 (Step S108). The paper is discharged onto the discharge tray 8 after having been sorted by the shifter processing.

Afterwards, a determination is made of whether or not there is a next print request (Step S109). That is, a determination is made of whether or not it is necessary to perform continuing print processing and shifter processing. When the result of this determination is that there is a next print request, the operation moves to Step S107 and repeatedly performs print processing and shifter processing until all print requests are finished. On the other hand, when the result of the determination in Step S109 is that there is not a next print request, this control is finished.

However, in the determination of Step S106, when shifter processing has not been selected, after print processing has been executed (Step S110), the paper is discharged from the discharge rollers 36*e* to the staple processing stage 72, and further, the paper is discharged to the discharge tray by the drive roller 75 and the second idler roller 77 of the discharge roller portion 74. Afterward, a determination is made of whether or not there is a next print request (Step S111). When the result of this determination is that there is a next print request, the operation moves to Step S110 and repeatedly performs print processing until all print requests are finished.

On the other hand, when the result of the determination in Step S111 is that there is not a next print request, this control is finished.

On the other hand, in the determination of Step S104, when staple processing has been selected, the idler roller holder 81 is rotated to the first position by driving the idler roller holder rotation motor gear 83 of the discharge roller portion 74, and the idler roller pressure arm 85 is rotated to the separation position by stopping the pressure arm drive solenoid 86. Thus, the first idler roller 76 faces, and is separated from, the drive roller 75 (Step S112).

Next, a determination is made of whether or not shifter processing is selected as a print condition (Step S113). When shifter processing has been selected, after print processing has been executed (Step S114), the paper is discharged from the discharge rollers 36*e* to the staple processing stage 72. Then, the paper that has been discharged to the staple processing stage 72 is adjusted. Specifically, the transport direction of the paper is adjusted by the paper sliding down along the slope of the staple processing stage 72 due to the paper's own weight, and the widthwise direction of the paper is adjusted by the adjusting plates 73. Next, a determination is made of whether or not print processing of one job that has been requested is completely finished (Step S115). Here, print processing for a predetermined number of pages of paper that are the target of one instance of staple processing is collectively referred to as print processing of one job. Because staple processing is performed after print processing for the predetermined number of pages of paper is completely finished, a determination is made in Step S115 of whether or not print processing for the predetermined number of pages of paper that are the target of one instance of staple processing has completely finished.

When the result of the determination in Step S115 is that the print processing of one job has not completely finished, the operation moves to Step S114, and the print processing is repeated until the print processing of one job finishes. On the other hand, when the print processing of one job has completely finished, next, staple processing is executed (Step S116). That is, in the paper post-processing portion 7, a staple is inserted at the desired staple position of the paper with the staple mechanism portion 71, binding the trailing edge portion of the paper stacked on the staple processing stage 72.

After staple processing is finished, the idler roller pressure arm 85 is rotated to the contact position by driving the pressure arm drive solenoid 86. Thus, the first idler roller 76 makes contact with the drive roller 75 (Step S117), and the paper batch is chucked by the rollers 75 and 76 after staple processing. Shifter processing is executed for the paper batch after staple processing, and afterward, the paper batch is discharged to the discharge tray 8 and one job is finished (Step S118). The paper batch is discharged onto the discharge tray 8 after having been sorted by the shifter processing.

Afterward, a determination is made of whether or not there is a next job (Step S119). That is, a determination is made of whether or not it is necessary to perform continuing print processing, staple processing, and shifter processing. When the result of this determination is that there is a next job, the idler roller pressure arm 85 is rotated to the separation position by stopping the pressure arm drive solenoid 86, and after the first idler roller 76 and the drive roller 75 have been separated (Step S120), the operation moves to Step S114, and the print processing, staple processing, and shifter processing are repeatedly performed until all jobs are complete. Whenever one job finishes, after staple processing a paper batch is discharged onto the discharge tray 8, after having been sorted by shifter processing. On the other hand, when the result of the determination in Step S119 is that there is not a next job, this control is finished.

On the other hand, when a determination is made in Step S113 that shifter processing has not been selected, after print processing has been executed (Step S121), the paper is discharged from the discharge rollers 36*e* to the staple processing stage 72. Then, the paper that has been discharged to the staple processing stage 72 is adjusted, and next, a determination is made of whether or not print processing of one job that has been requested is completely finished (Step S122). When the result of this determination is that print processing of one job has not completely finished, the operation moves to Step S121, and print processing is repeatedly performed until print processing of one job finishes. On the other hand, when print processing of one job has completely finished, next, staple processing is executed (Step S123).

After staple processing is finished, the idler roller pressure arm 85 is rotated to the contact position by driving the pressure arm drive solenoid 86. Thus, the first idler roller 76 makes contact with the drive roller 75 (Step S124), and the paper batch is chucked by the rollers 75 and 76 after staple processing. Then, the paper batch is discharged to the discharge tray 8 after staple processing, and one job is finished (Step S125).

Afterward, a determination is made of whether or not there is a next job (Step S126). That is, a determination is made of whether or not it is necessary to perform continuing print processing and staple processing. When the result of this determination is that there is a next job, after the idler roller pressure arm 85 is rotated to the separation position by stopping the pressure arm drive solenoid 86 and the first idler roller 76 and the drive roller 75 are separated (Step S127), the operation moves to Step S121 and repeatedly performs print processing and staple processing until all jobs are finished. A paper batch is discharged onto the discharge tray 8 after staple processing whenever one job finishes. On the other hand, when the result of the determination in Step S126 is that there is not a next job, this control is finished.

The present invention may be embodied in other forms without departing from the gist or essential characteristics thereof. The embodiments disclosed in this application are to be considered in all respects as illustrative and not limiting. The scope of the invention is indicated by the appended claims rather than by the foregoing description, and all changes that come within the meaning and range of equivalency of the claims are intended to be embraced therein.

What is claimed is:

1. An image forming apparatus in which an original reading portion is disposed in an upper portion of an apparatus main body, a feed portion is disposed in a lower portion of the apparatus main body, and a print portion is disposed between the original reading portion and the feed portion, comprising:

a control portion, a paper post-processing portion that performs paper post-processing for paper transported from the apparatus main body after printing by the print portion is finished, disposed in a space of the apparatus main body formed by the original reading portion, the print portion, and the feed portion, a drive roller provided in a discharge roller portion that discharges paper from the paper post-processing portion to a discharge portion, and at least two idler rollers provided in the discharge roller portion that form a pair with the drive roller and can be selectively used when discharging paper to the discharge portion, wherein the idler roller to be used for paper discharge is selected by the control portion according to the presence or absence of staple processing in the paper post processing portion.

2. The image forming apparatus according to claim 1, wherein at least one of the idler rollers is a first idler roller used when staple processing is performed by the paper post-processing portion, and the first idler roller is provided such that it can be put in contact with or separated from the drive roller with which it forms a pair.

3. The image forming apparatus according to claim 2, wherein the drive roller and the first idler roller with which it forms a pair are in a separated state when staple processing is performed in the paper post-processing portion.

4. The image forming apparatus according to claim 3, wherein the drive roller and the first idler roller with which it forms a pair are in a contact state after staple processing is performed in the paper post-processing portion.

5. The image forming apparatus according to claim 2, wherein the first idler roller that forms a pair with the drive roller is provided such that it can actively rotate with the drive roller when discharging a paper batch to the discharge portion after staple processing.

6. The image forming apparatus according to claim 5, wherein an idler roller side drive portion that links with a drive roller side drive portion provided in the drive roller is provided in the first idler roller that forms a pair with the drive roller.

7. The image forming apparatus according to claim 2, wherein a second idler roller that is other than the first idler roller of the idler rollers and that is used when staple processing is not performed in the paper post-processing portion is in contact with the drive roller with which it forms a pair.

8. The image forming apparatus according to claim 7, wherein the second idler roller idly rotates with rotation of the drive roller when discharging paper to the discharge portion.

9. The image forming apparatus according to claim 7, wherein a contacting nip region when the first idler roller and the drive roller with which it makes a pair are in contact is larger than the contacting nip region when the second idler roller and the drive roller with which it makes a pair are in contact.

10. The image forming apparatus according to claim 7, wherein the hardness of the outer circumferential portion of the first idler roller is less than the hardness of the outer circumferential portion of the second idler roller.

11. The image forming apparatus according to claim 1, wherein the drive roller and a plurality of the idler rollers provided in the discharge roller portion are also used as shifter rollers that performs shifter processing.

12. An image forming apparatus, comprising:

a control portion, a paper post-processing portion that performs paper post-processing for transported paper, a discharge roller portion that discharges paper from the paper post-processing portion, a drive roller provided in a discharge roller portion, and at least two idler rollers provided in the discharge roller portion that form a pair with the drive roller and can be selectively used when discharging paper, wherein the idler roller to be used for paper discharge is selected by the control portion according to the presence or absence of staple processing in the paper post-processing portion.

* * * * *